US006089157A

United States Patent [19]

Becker et al.

[11] Patent Number: 6,089,157

[45] Date of Patent: Jul. 18, 2000

[54] METHOD AND DEVICE FOR TRANSFERRING A SHEET, BY A TRAILING EDGE THEREOF, IN A REVERSING DEVICE OF A SHEET-FED ROTARY PRINTING PRESS

[75] Inventors: Willi Becker, Bammental; Andreas Fricke, Eberbach, both of Germany

[73] Assignee: Heidelberger Druckmaschinen Aktiengesellschaft, Heidelberg, Germany

[21] Appl. No.: 09/201,698

[22] Filed: Nov. 30, 1998

[30] Foreign Application Priority Data

Nov. 28, 1997 [DE] Germany ..... 197 52 680

[51] Int. Cl.[7] ..... B41F 21/04; B41F 5/02

[52] U.S. Cl. ..... 101/230; 101/409; 271/276

[58] Field of Search ..... 101/409, 230, 101/231, 232; 271/276

[56] References Cited

U.S. PATENT DOCUMENTS

| | | | |
|---|---|---|---|
| 3,537,391 | 11/1970 | Mowry et al. | 101/230 |
| 3,654,861 | 4/1972 | Rudolph et al. | 101/230 |
| 4,018,161 | 4/1977 | Johne et al. | 101/230 |
| 4,928,586 | 5/1990 | Kida | 101/230 |
| 4,930,414 | 6/1990 | Wirz | 101/230 |
| 5,762,333 | 6/1998 | Sugiyama et al. | 101/230 |

FOREIGN PATENT DOCUMENTS

| | | |
|---|---|---|
| 2 635 719 | 3/1988 | France . |
| 1 810 589 | 5/1970 | Germany . |
| 196 17 544 C1 | 4/1997 | Germany . |
| 1 462745 | 1/1977 | United Kingdom . |
| 2 202 828 | 10/1988 | United Kingdom . |

*Primary Examiner*—Eugene Eickholt
*Attorney, Agent, or Firm*—Herbert L. Lerner; Laurence A. Greenberg; Werner H. Stemer

[57] ABSTRACT

A method for transferring, by a trailing edge thereof, a sheet conveyed on an upline sheet-conveying cylinder to a gripper device of a downline sheet-conveying cylinder in a reversing device of a sheet-fed rotary printing press, the gripper device having sheet-holding surfaces for accepting the sheet trailing edge, which comprises lifting the sheet by the trailing edge thereof from the upline sheet-conveying cylinder; moving the sheet-holding surfaces of the gripper device out of the periphery of the downline sheet-conveying cylinder; with the sheet-holding surfaces of the gripper device, accepting the sheet trailing edge outside the periphery of the downline sheet-conveying device; and moving the sheet-holding surfaces back into the periphery of the downline sheet-conveying cylinder; and a transferring device for performing the method.

22 Claims, 8 Drawing Sheets

METHOD AND DEVICE FOR TRANSFERRING A SHEET, BY A TRAILING EDGE THEREOF, IN A REVERSING DEVICE OF A SHEET-FED ROTARY PRINTING PRESS

BACKGROUND OF THE INVENTION

FIELD OF THE INVENTION

The invention relates to a method and a device for transferring a sheet, by a trailing edge thereof, in a reversing device of a sheet-fed rotary printing press, and more particularly, a sheet conveyed on an upline sheet-conveying cylinder, in particular, an impression cylinder, to a gripper device formed with sheet-retaining surfaces for receiving the trailing edge of the sheet, the gripper device being provided on a downline sheet-conveying cylinder in the reversing device of the sheet-fed rotary printing press.

In order to print on both sides of sheet-like material in a sheet-fed rotary printing press during a recto/verso or first-form and perfector printing operation, it is necessary to turn the sheet over with a reversing device, after the upper side of the sheet has been printed, in order to be able then to print on the rear side of the sheet.

The Published Non-Prosecuted Patent Application (DE-OS) 24 51 987 discloses a reversing device wherein, during recto/verso or first-form and perfector printing operation, the trailing edge of a sheet conveyed on an impression cylinder is gripped by a suction gripper pivotable outwardly from the periphery of a downline sheet-conveying cylinder, and before passing a central transfer location between the two cylinders, is guided into the periphery of the downline sheet-conveying cylinder. In the periphery of the downline sheet-conveying cylinder, the sheet trailing edge is then transferred to a further gripper device, the latter transferring the sheet trailing edge to a third gripper device, which is likewise pivotably arranged in the periphery. In order to counteract a relative movement between the sheet trailing edge and those parts of the sheet which still adhere to the impression cylinder, a movement which leads to errors, the suction gripper is guided on a trochoidal path when it is being moved into the periphery of the downline sheet-conveying cylinder. Because the transfer of the sheet trailing edge takes place in the interior of the periphery, and because of the complexity of the transmissions which are used, register-maintaining transfer is not possible with the afore-described reversing device, in particular, at high continuous printing speeds. In addition, in the hereinaforedescribed device, centrifugal force tends to produce a billowing in the sheets, particularly those having greater paper weights, more specifically, in a trailing part of the sheets which is lifted from the impression cylinder by the suction grippers, and this additionally presents an obstacle to the in-register takeover of the sheets by the succeeding gripper devices.

The published German Patent Document DE 38 29 626 C2 describes a sheet-fed rotary printing press having a reversing device wherein, during a perfector printing operation, the sheet trailing edge is lifted from the upline impression cylinder by a suction gripper that can be pivoted out of the periphery of a downline sheet-conveying cylinder. When the suction gripper is moved back under the periphery of the downline sheet-conveying cylinder, the movement of the suction gripper is controlled by a transmission so that the sheets are tautened counter to the direction of rotation of the downline sheet-conveying cylinder.

Due to the transfer of the sheet trailing edge by the suction grippers within the periphery of the downstream sheet-conveying cylinder in the devices according to the afore-mentioned published German Patent Document DE 38 29 626 C2 and German Non-prosecuted Patent Application (DE-OS) 24 51 987, comparatively large relative movements occur between the sheets and the gripper devices arranged in the interior and, in the case wherein there is no follow-up control for the grippers and suckers which are used, these relative movements may lead, for example, to so-called "picking", because the gripper holding the sheet leading edge remains closed, which, in turn, involves serious register problems. Furthermore, because of unequal closing and unequal opening of the grippers, respectively, as often occurs between the drive side and the operator side of a sheet-fed rotary printing machine because of the elasticity of the gripper shafts, it is possible for "picking " to occur at different times between the drive side and the operator side. The causes for the varying gripper closure are dynamically induced and are produced, for example, by varying gripper shaft torsion, differences in rotary speed, and so forth. Furthermore, in particular, in the case of thick printed materials, it is possible for stresses which cause register errors to occur in the sheet. These stresses can be attributed to the fact that the joint gripper closure period between the opening of the leading-edge gripper of the impression cylinder and the closing of the trailing-edge gripper, which is usually in the range of about 1 to 2 degrees of arc of the printing press, is further enlarged as a result of the increased thickness of the printed materials.

SUMMARY OF THE INVENTION

It is accordingly an object of the invention to provide a method and a device for transferring the trailing edge of a printed sheet in a turning device of a sheet-fed rotary printing press which avoid the disadvantages of the prior art and ensure register-maintaining and accurately registered transfer of the sheet trailing edge even at high production printing speeds and during the processing of printed material having great thicknesses.

With the foregoing and other objects in view, there is provided, in accordance with a first aspect of the invention, a method for transferring, by a trailing edge thereof, a sheet conveyed on an upline sheet-conveying cylinder to a gripper device of a downline sheet-conveying cylinder in a reversing device of a sheet-fed rotary printing press, the gripper device having sheet-holding surfaces for accepting the sheet trailing edge, which comprises lifting the sheet by the trailing edge thereof from the upline sheet-conveying cylinder; moving the sheet-holding surfaces of the gripper device out of the periphery of the downline sheet-conveying cylinder; with the sheet-holding surfaces of the gripper device, accepting the sheet trailing edge outside the periphery of the downline sheet-conveying device; and moving the sheet-holding surfaces back into the periphery of the downline sheet-conveying cylinder.

In accordance with another mode, the method includes accepting the sheet trailing edge by the sheet-holding surfaces a few radians away from an imaginary connecting line between the centers of rotation of the upline and the downline sheet-conveying cylinders.

In accordance with a further mode, the method includes accepting the sheet trailing edge with the sheet-holding surfaces on or in the vicinity of a line running between the peripheries of the cylinders and disposed perpendicularly to an imaginary line connecting the centers of rotation of the upline and downline sheet-conveying cylinders.

In accordance with an added mode, the method includes moving the sheet-holding surfaces of the gripper device of the downline sheet-conveying cylinder several millimeters out of the periphery of the downline sheet-conveying cylinder.

In accordance with an additional mode, the method includes swiveling the gripper device so as to move the sheet-holding surfaces out of the periphery of the downline sheet-conveying cylinder and back into the periphery.

In accordance with yet another mode, the method includes, during the transfer of the sheet trailing edge to the sheet-holding surfaces of the gripper device, maintaining the sheet-holding surfaces of the gripper device and a sheet lifter at rest with respect to the downline sheet-conveying cylinder.

In accordance with yet a further mode, the method includes swiveling the suction gripper out of the periphery of the downline sheet-conveying cylinder so as to lift the sheet trailing edge from the upline sheet-conveying cylinder.

In accordance with yet an added mode, the method includes tautening the sheet trailing edge through the intermediary of the sheet-holding surfaces before the sheet is transferred by the trailing edge thereof to the gripper device.

In accordance with yet an additional mode, the method includes, after the gripper device of the downline sheet-conveying cylinder has gripped the sheet trailing edge, swiveling the gripper device of the downline sheet-conveying cylinder so that the sheet-holding surfaces are oriented at least approximately in the direction of a length of the sheet extending from the upline sheet-conveying cylinder to the gripper device of the downline sheet-conveying cylinder.

In accordance with another mode, the method includes, through the intermediary of the gripper device of the downline sheet-conveying cylinder, transferring the trailing edge of the sheet to a further gripper device of the downline sheet-conveying cylinder.

In accordance with a second aspect of the invention, there is provided a device for transferring a sheet guided on an upline sheet-conveying cylinder by a trailing edge of the sheet to a downline sheet-conveying cylinder of a reversing device in a sheet-fed rotary printing press, comprising a device for lifting the sheet trailing edge from the upline sheet-conveying cylinder, and a gripper device disposed on the downline sheet-conveying cylinder and formed with sheet-holding surfaces movable out of the periphery of the downline sheet-conveying cylinder for accepting the sheet trailing edge from the lifting device outside the periphery of the downline sheet-conveying cylinder and for moving the sheet trailing edge back into the periphery of the downline sheet-conveying cylinder, after the sheet trailing edge has been accepted by the sheet-holding surfaces.

In accordance with another feature of the invention, the sheet-holding surfaces are movable for accepting the sheet trailing edge a few radians away from an imaginary line mutually connecting respective centers of rotation of the upline and the downline sheet-conveying cylinders.

In accordance with a further feature of the invention, the sheet-holding surfaces of the gripper device are movable several millimeters outside of the periphery of the downline sheet-conveying cylinder.

In accordance with an added feature of the invention, the sheet-holding surfaces of the gripper device are movable for accepting the sheet trailing edge on or in the vicinity of a line running between the peripheries of the upline and the downline sheet-conveying cylinders and disposed perpendicularly to an imaginary line connecting centers of rotation of the upline and the downline sheet-conveying cylinders.

In accordance with an additional feature of the invention, the gripper device is swivelable so that the sheet-holding surfaces are oriented at least approximately in the direction of a length of the sheet extending from the upline sheet-conveying cylinder to the gripper device.

In accordance with yet another feature of the invention, during transfer of the sheet trailing edge to the sheet-holding surfaces of the gripper device, the sheet-holding surfaces of the gripper device and the sheet lifting device being at rest with respect to the downline sheet-conveying cylinder.

In accordance with yet a further feature of the invention, the sheet lifting device is formed by a suction gripper swivelable out of the periphery of the downline sheet-conveying cylinder.

In accordance with yet an added feature of the invention, the sheet lifting device is constructed so as to tauten the sheet before it is accepted at the sheet trailing edge thereof by the gripper device.

In accordance with yet an additional feature of the invention, the transferring device includes a further gripper device for accepting the sheet by the trailing edge thereof, the further gripper device being disposed on the downline sheet-conveying cylinder.

In accordance with still another feature of the invention, the further gripper device has a tongs-type gripper.

In accordance with still a further feature of the invention, the first-mentioned gripper device is formed by a tongs-type gripper device.

In accordance with a concomitant feature of the invention, the upline sheet-conveying cylinder is an impression cylinder.

Other features which are considered as characteristic for the invention are set forth in the appended claims.

Although the invention is illustrated and described herein as embodied in a method and a device for transferring a sheet, by a trailing edge thereof, in a reversing device of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
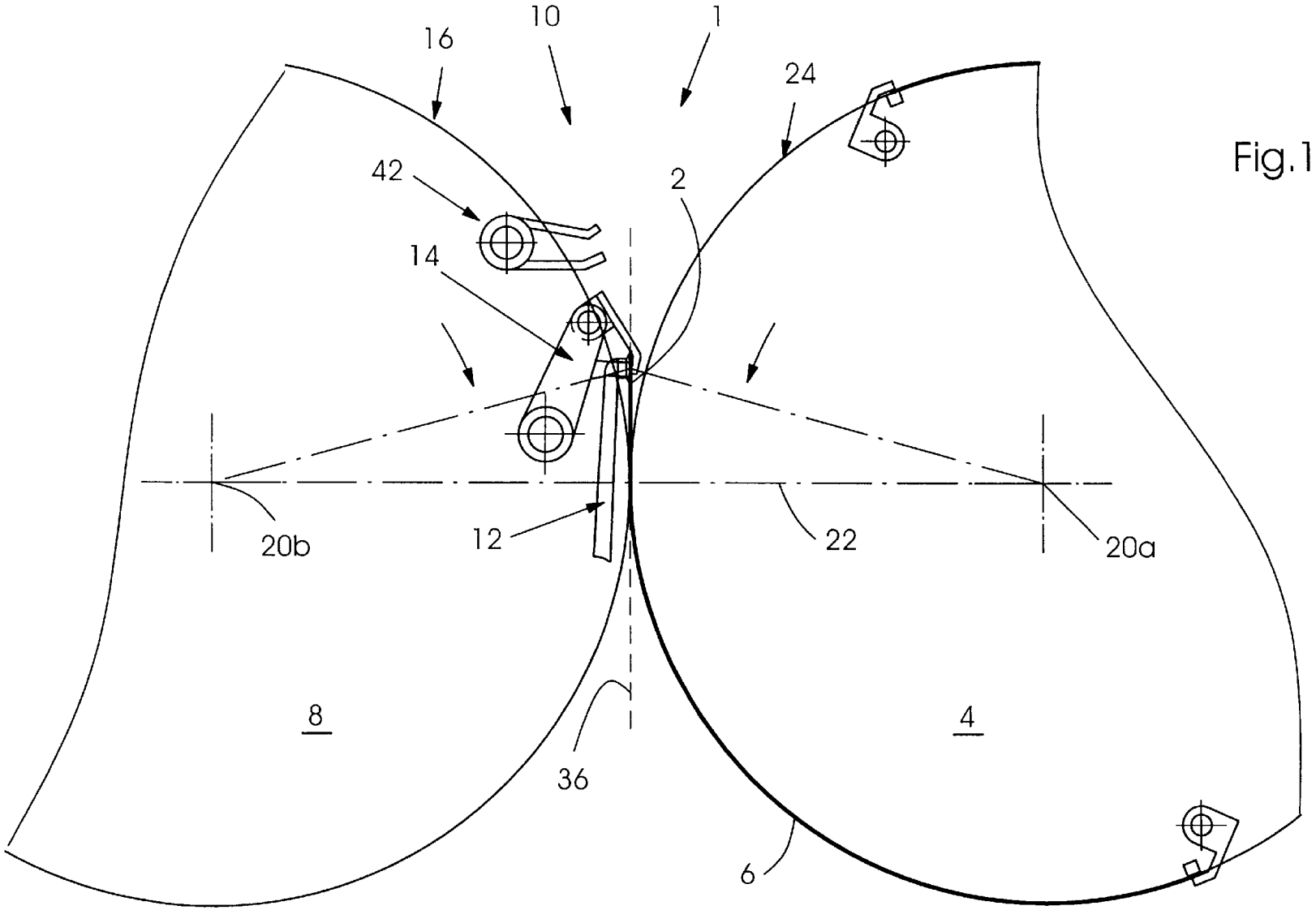
FIG. 1 is a fragmentary, diagrammatic side elevational view of an upline sheet-conveying cylinder and a downline sheet-conveying cylinder of a reversing device having a device according to the invention for transferring, by a trailing edge thereof, a sheet conveyed on the upline sheet-conveying cylinder.

Referring now to the drawings and, first, particularly to FIG. 1 thereof, there is shown therein a device 1 for transferring, in accordance with the invention of the instant application, a trailing edge 2 of a sheet 6 which is conveyed on an upline sheet-conveying cylinder 4 to a downline sheet-conveying cylinder 8 of a reversing or turning device 10 having a sheet lifting device 12 and a gripper device 14 arranged on the downline sheet-conveying cylinder 8. The sheet lifting device 12 may be formed, for example, of one or more suction grippers 18, which are illustrated in FIGS. 2*a* to 2*d* and 3*a* to 3*c* and are pivotable out of the periphery 16 of the downline sheet-conveying cylinder 8, as is described, for example, in the aforementioned published German Patent Document DE 39 29 626 c2.

Figure 2A:
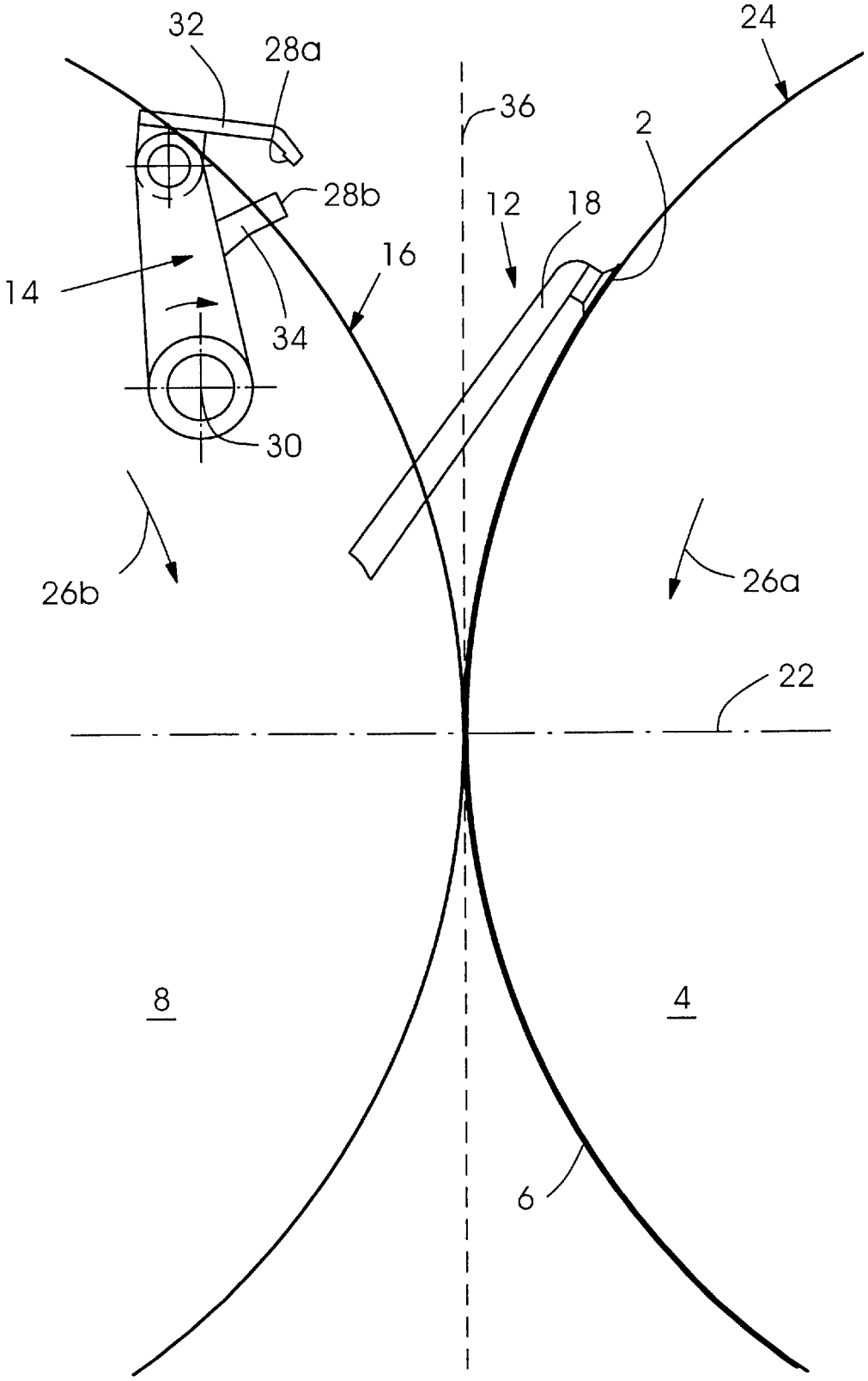
FIGS. 2*a* to 2*d* are fragmentary views of FIG. 1 showing diagrammatically various stages of the transfer of a printed sheet by the trailing edge thereof in a first embodiment of the transfer device according to the invention.

As is shown in FIG. 2*a*, in order to transfer the sheet 6 by the trailing edge 2 thereof, the suction gripper 18 is pivoted out of the periphery 16 of the downline sheet-conveying cylinder 8 at a location that is several printing-press degrees of arc, for example 10° to 40°, away from an imaginary connecting line 22 between the centers of rotation 20*a* and 20*b* of the upline and downline sheet-conveying cylinders 4 and 8, respectively, and is pivoted or swiveled up to the periphery 24 of the upline sheet-conveying cylinder 4, whereat it grips the trailing edge 2 of the sheet 6 which is conveyed on the upline sheet-conveying cylinder 4. The upline sheet-conveying cylinder 4 may be, for example, an impression cylinder of a printing unit, which has a diameter that is twice that of the plate cylinder and/or blanket cylinder associated therewith. Although the outward swiveling of the suction gripper 18 is shown in the figures in the region upline from the imaginary connecting line 22, the outward swiveling can also take place in a similar manner after the suction gripper 18 has passed the connecting line 22, i.e., in the region of the lower half of FIGS. 2*a* to 2*c* and 3*a* to 3*c*.

After the sucker of the suction gripper 18 has gripped the sheet trailing edge 2, the sucker swivels or pivots back in a direction towards the periphery 16 of the cylinder 8, the pivoting operation being controlled by an otherwise non-illustrated cam mechanism. In this regard, provision may be made for the movement of the suction gripper 18 to be controlled by the non-illustrated cam mechanism so that the sheet 6 is tautened counter to the direction of rotation of the cylinders 4 and 8, respectively, as indicated by the arrows 26*a* and 26*b*, respectively, while the sheet 6 remains at rest completely on the circumferential surface of the upline sheet-conveying cylinder 4. In a similar manner, provision may also be made, however, for the sheet 6 to be tautened by the suction gripper 18 also additionally during and/or after the sheet trailing edge 2 has been lifted from the circumferential surface of the upline sheet-conveying cylinder 4.

At substantially the same time at which the sheet trailing edge 2 is gripped and/or lifted by the suction gripper 18, sheet-holding or sheet-retaining surfaces 28*a* and 28*b* of the gripper device 14 are moved out of the periphery 16 of the downline sheet-conveying cylinder 8. In the preferred embodiment of the invention illustrated in FIGS. 2*a* to 2*c*, the gripper device 14 is preferably formed by a conventional gripper device that is swivelable or pivotable about an axis of rotation 30 via a non-illustrated cam mechanism, one of the sheet-holding surfaces 28*a* being formed on a gripper finger 32 and the other sheet-holding surface 28*b* being formed on a gripper pad 34 of the gripper device 14.

Figure 2B:
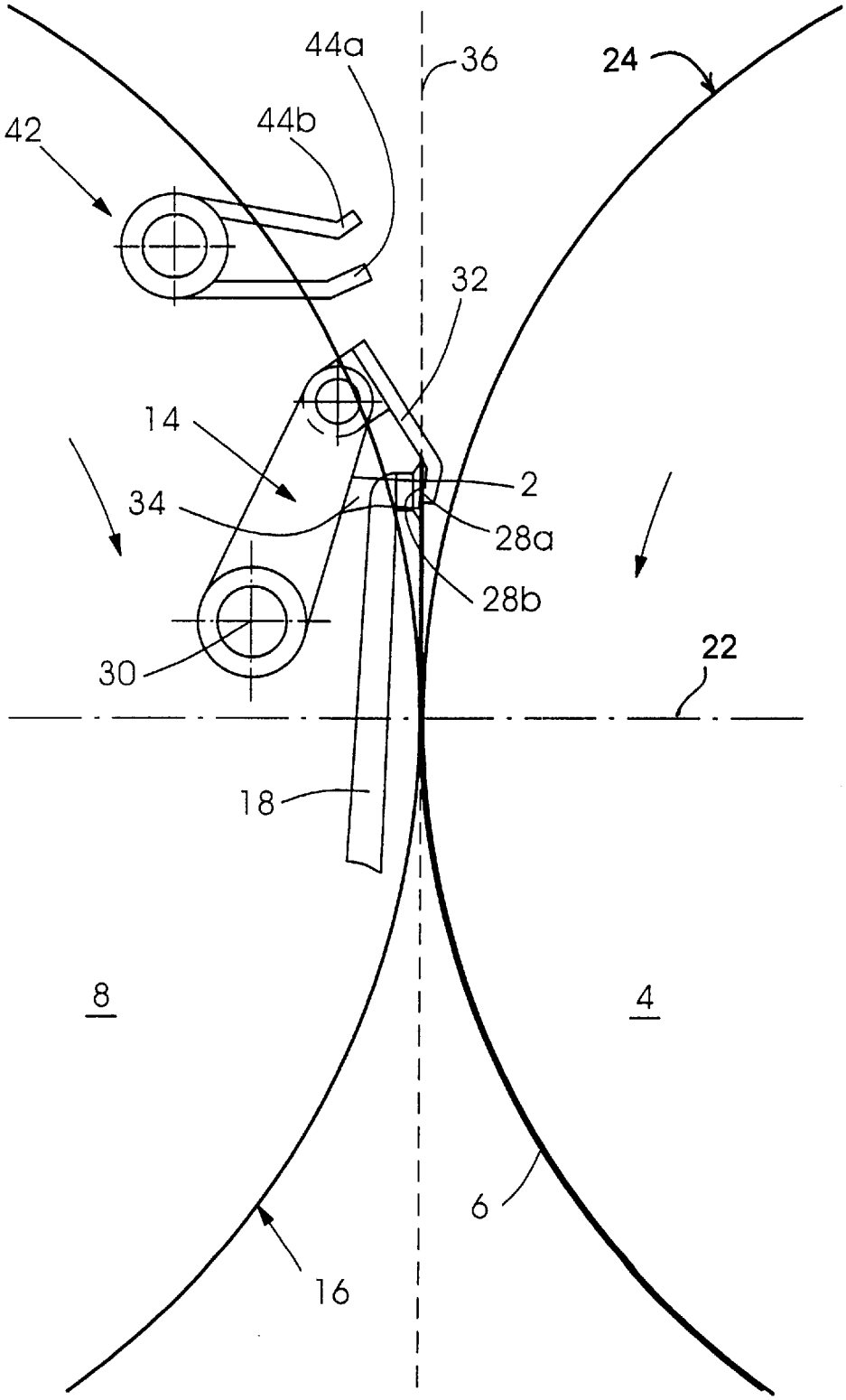

As is shown in FIG. 2*b*, the first and second sheet-holding surfaces 28*a* and 28*b* moved out of the periphery 16 of the downstream sheet-conveying cylinder 8 grip the trailing edge 2 of the sheet 6 outside the periphery 16 of the downline sheet-conveying cylinder 8, while the trailing edge 2 of the sheet 6 is held taut by the suction gripper 18. In this regard, the sheet trailing edge 2 is gripped by the sheet-holding surfaces 28*a* and 28*b*, or the sheet trailing edge 2 is taken over from the suction grippers 18 by the sheet-holding surfaces 28*a* and 28*b* of the gripper device 14, preferably on or in the vicinity of a line 36 running between the peripheries 16 and 24 of the cylinders 4 and 8, respectively, and is arranged perpendicular to the imaginary line 22 connecting the centers of rotation 20*a* and 20*b* of the respective cylinders 4 and 8. In the interest of simplicity, the line 36 is referred to hereinbelow as a tangent line although, strictly speaking, it is located in the center of a nip formed between the two peripheral surfaces 16 and 24 of the respective cylinders 4 and 8, which may, for example, have a nip width of several tenths of a millimeter. During the transfer of the sheet 6 by the trailing edge 2 thereof to the sheet-holding surfaces 28*a* and 28*b*, both of the latter and the suction gripper 18 are preferably at rest with respect to the downline cylinder 8.

As has been shown hereinbefore, transferring the sheet 6 by the trailing edge 2 thereof outside the periphery 16 of the downline sheet-conveying cylinder 8, particularly on or in the vicinity of the tangent line 36, results in the advantage that, during the transfer of the sheet 6 by the trailing edge 2 thereof to the sheet-holding surfaces 28*a* and 28*b* of the gripper device 14, until the sheet leading edge is released by the associated gripper device of the upline cylinder, virtually no relative movements occur between the sheet-holding surfaces 28*a* and 28*b*, on the one hand, and the sheet trailing edge 2, on the other hand. This rules out negative effects upon the transfer register during a recto/verso or first-form and perfector printing operation. Thus, the relative movements in the case of the device according to the invention are within the range of a few thousandths of a millimeter per degree of arc or radian of the printing press, whereas, in the case of conventional reversing or turning devices with transfer clearly below the periphery, the relative movements may amount to several tenths of a millimeter per degree of arc or radian of the printing press.

Figure 2C:
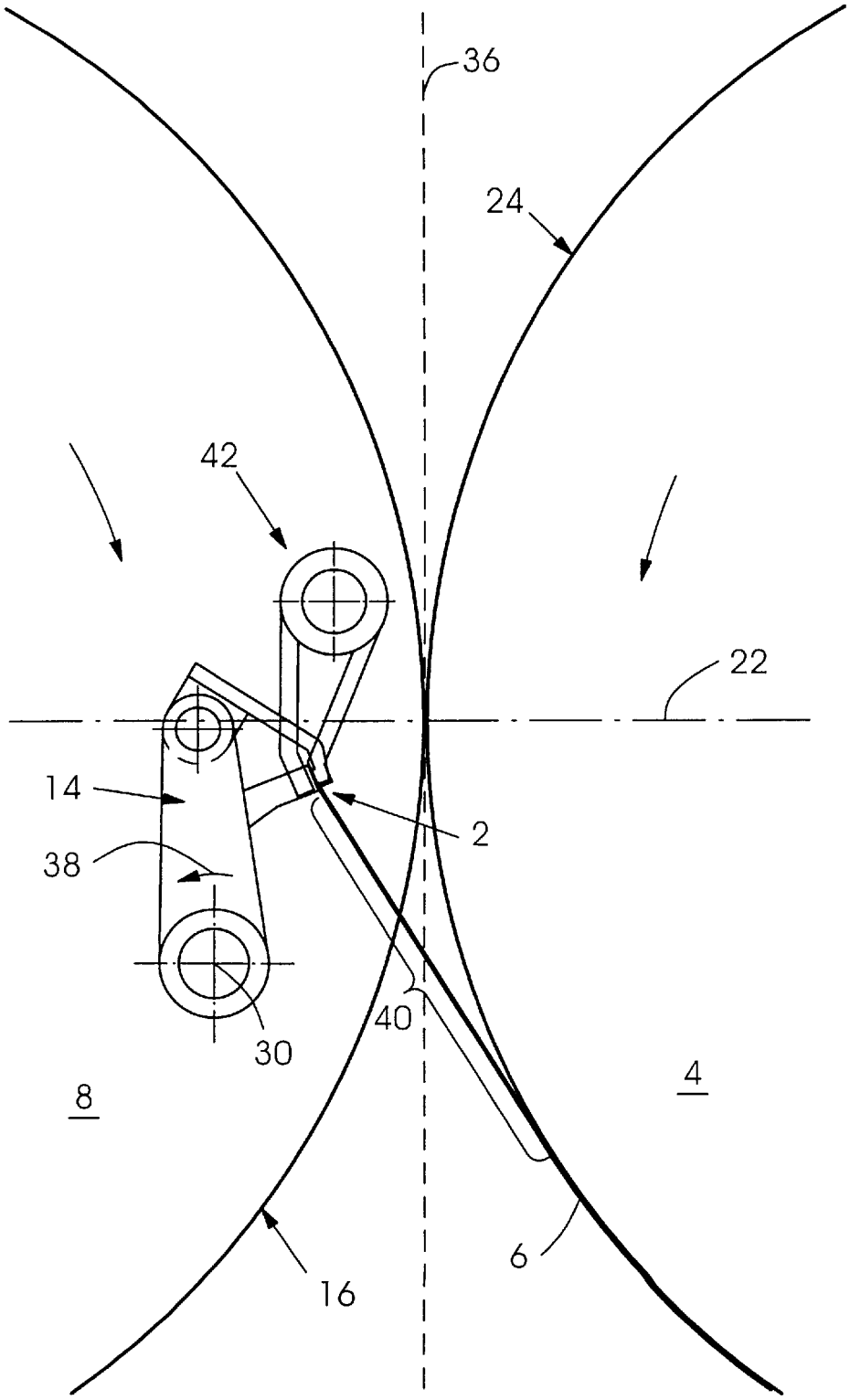
Figure 2D:
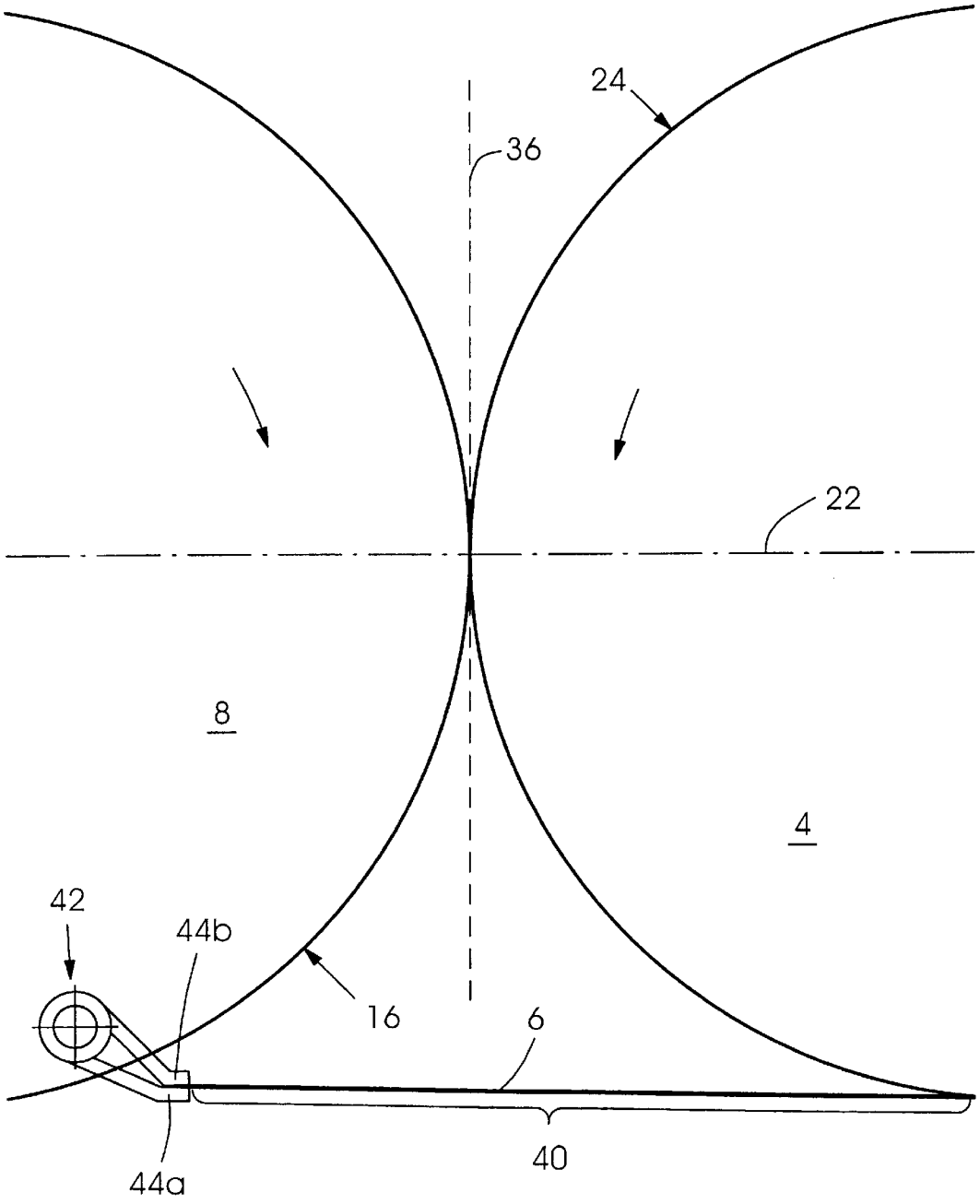

As indicated in FIG. 2*c* by the arrow 38, after the sheet trailing edge 2 has been gripped and the sheet leading edge has been released, the gripper device 14 is swiveled or pivoted back about the axis 30 so that the sheet-holding surfaces 28*a* and 28*b* which hold the sheet trailing edge 2 are moved back into the periphery 16 of the downline sheet-conveying cylinder 8 before they pass the imaginary line 22. The gripper device 14 is preferably swiveled or pivoted about the axis 30 so that the sheet-holding surfaces 28*a* and 28*b* are oriented virtually always in the direction of that section or length 40 of the sheet 6 which extends from the upline sheet-conveying cylinder 4 to the gripper device 14. Assurance is thereby provided that the sheet trailing edge 2 held by the sheet-holding surfaces 28*a* and 28*b* does not become kinked in a disadvantageous manner.

As is further illustrated in FIG. 2*c*, the gripper device 14 then transfers the sheet trailing edge 2 to a further gripper device 42, which can be constructed, for example, as a swivelable or pivotable tongs-type gripper device arranged within the periphery 16 of the downline sheet-conveying cylinder 8. The further gripper device 42 may also have angled-away sheet-holding surfaces 44*a* and 44*b*, and, during further rotation of the cylinders 4 and 8, is preferably swiveled or pivoted in the manner shown in FIG. 2*d* so that, subsequent to the swiveling or pivoting, the sheet trailing edge 2 runs directly in the region of the periphery 16 of the downline sheet-conveying cylinder 8. Consequently, the sheet trailing edge 2 of the reversed sheet 6 can then be transferred in a conventional manner to a conventional non-illustrated gripper device of a further downline sheet-conveying cylinder, for example, an impression cylinder in a downline printing unit.

Figure 3A:
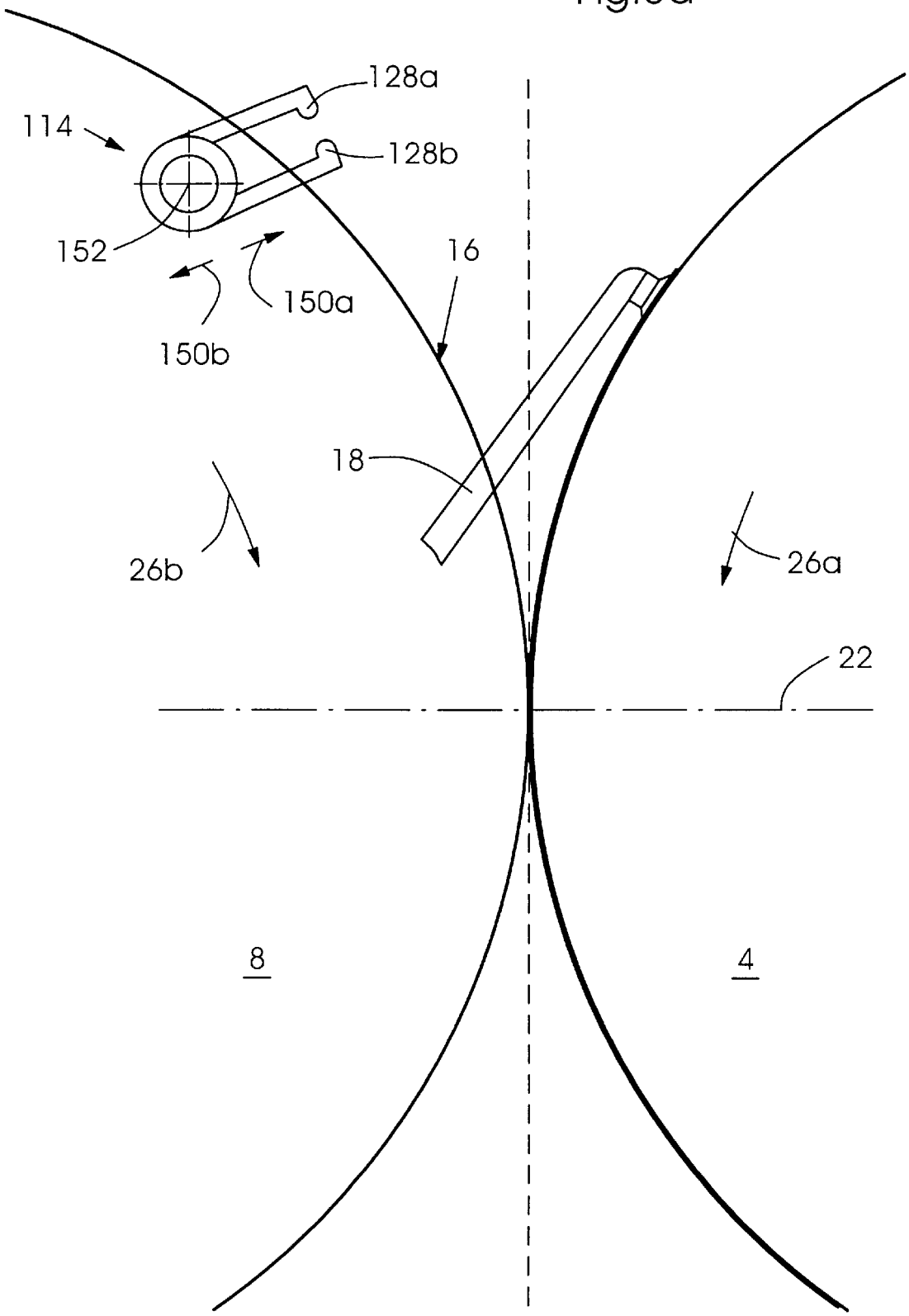
FIGS. 3*a* to 3*c* are views like those of FIGS. 2*a* to 2*c* diagrammatically showing various stages of the transfer of a printed sheet by the trailing edge thereof in a second embodiment of the transfer device according to the invention, wherein the gripper device of the downline sheet-conveying cylinder is formed by a single, pivotable tongs-like gripper that is movable out of the periphery of the cylinder.
Figure 3B:
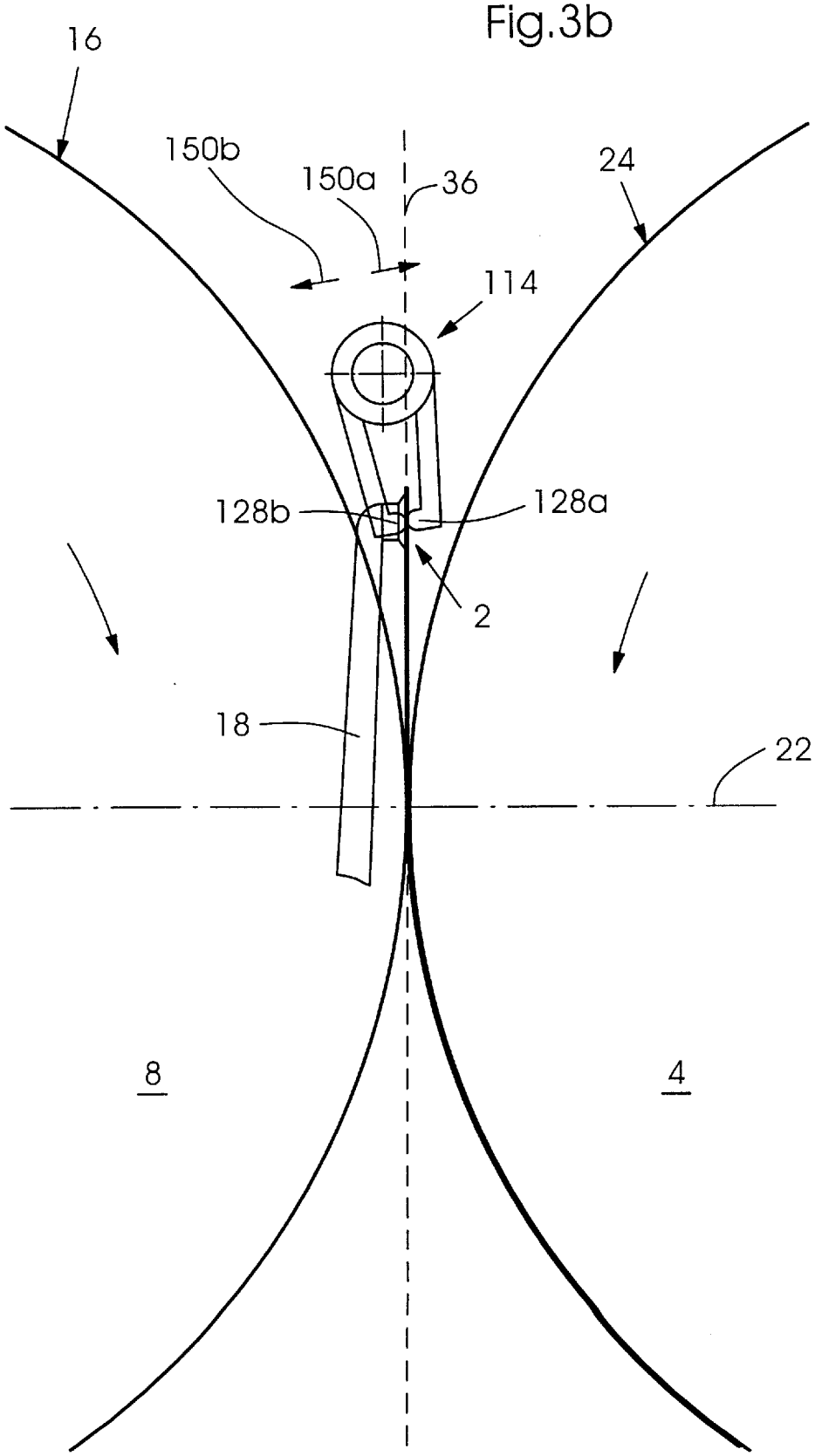
Figure 3C:
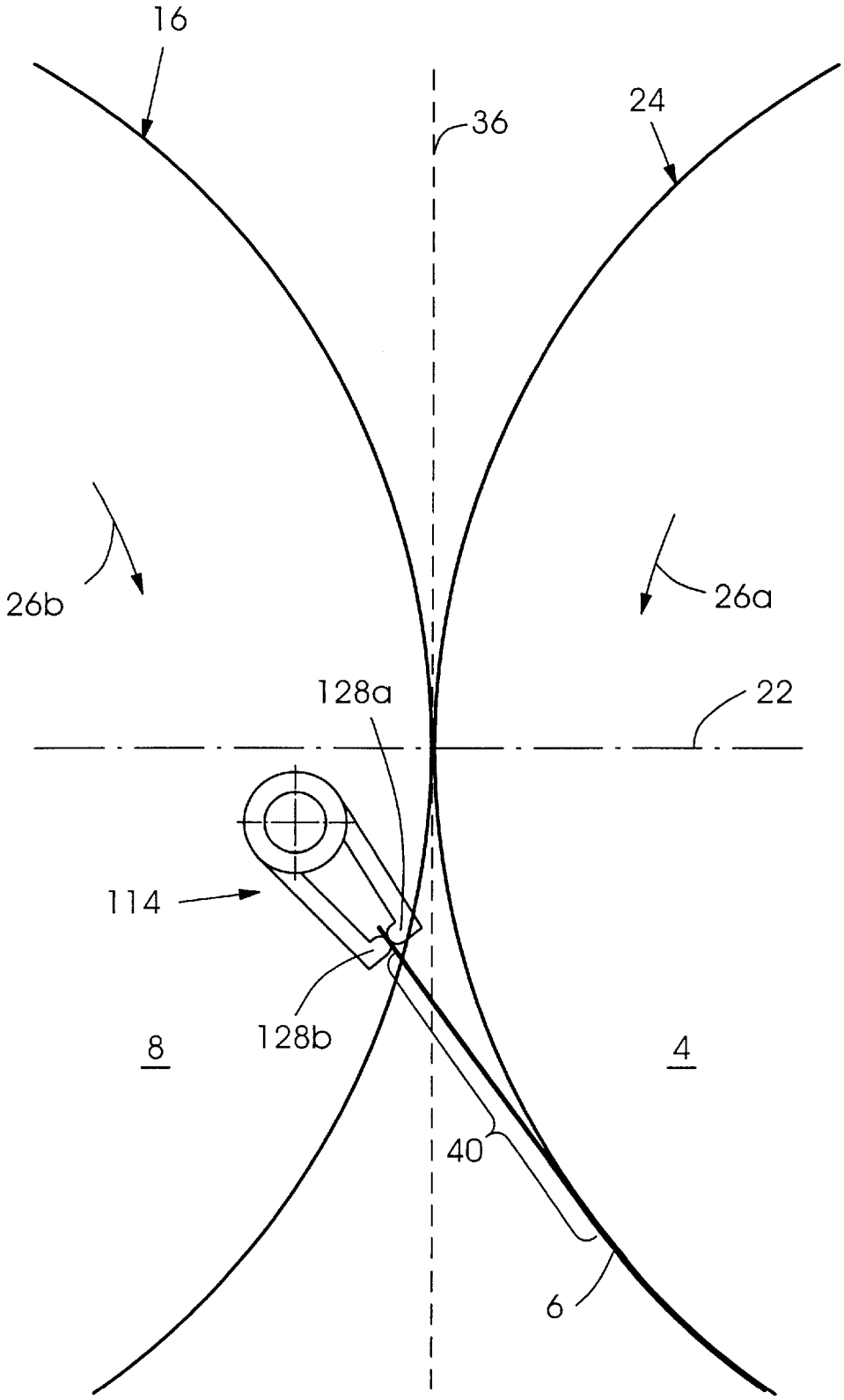

In accordance with a further embodiment of the invention illustrated in FIGS. 3*a* to 3*c*, the gripper device of the downline sheet-conveying cylinder 8 may be constructed directly as a conventional tongs-type gripper device 114, which has preferably spherical sheet-holding surfaces 128*a* and 128*b*. As indicated in FIG. 3*b* by the arrows 150*a* and 150*b*, the tongs-type gripper device 114 of the downline sheet-conveying cylinder 8 can be moved out of the periphery 16 of the downline sheet-conveying cylinder 8, for example, by a non-illustrated swiveling or pivoting drive which acts upon the gripper shaft 142 of the tongs-type gripper device 114.

In the same manner as in the embodiment of the invention described in conjunction with FIGS. 2*a* to 2*d*, the trailing edge 2 of the sheet 6 which is lifted, in the embodiment of the invention shown in FIGS. 3*a* to 3*c*, from the upline sheet-conveying cylinder 4 by the suction gripper 18, is taken over by the sheet-holding surfaces 128*a* and 128*b* of the tongs-type gripper device 114 outside the periphery 16 of the downline sheet-conveying cylinder 8, preferably in the vicinity of the tangent line 36, as shown in FIG. 3*b*. During the transfer of the sheet trailing edge 2 to the sheet-holding surfaces 128*a* and 128*b* of the gripper device 114, the sheet-holding surfaces 128*a* and 128*b* and the suction gripper 18 are preferably at rest with respect to the downline cylinder 8.

Immediately after the sheet trailing edge 2 of the sheet 6 has been gripped by the sheet-holding surfaces 128*a* and 128*b* of the tongs-type gripper device 114, and after the sheet leading edge has been released by the otherwise not specifically identified gripper device, the tongs-type gripper device 114 is moved back in the direction of the arrow 150*b* into the periphery 16 of the downstream sheet-conveying cylinder 8, so that no collision occurs between the gripper device 114 and the surface of the upline sheet-conveying cylinder 4 when the gripper device 114 holding the sheet trailing edge 2 passes the connecting line 22 between the centers of rotation 20*a* and 20*b* of the respective cylinders 4 and 8.

In the same manner as in the case of the embodiment according to FIGS. 2*a* to 2*d*, provision may also be made, in the case of the embodiment of the invention shown in FIGS. 3*a* to 3*c*, for the tongs-type gripper device 114 to be swiveled or pivoted, during and/or after being moved into the periphery 16 of the cylinder 8, so that the trailing edge 2 of the sheet 6 lies subtantially tangentially in the spherical sheet-holding surfaces 128*a* and 128*b* as the respective cylinders 4 and 8 rotate further, and is not bent away from that length or section 40 of the sheet which extends from the upstream sheet-conveying cylinder 4 to the gripper device 114 (FIG. 3*c*).

The distance through which the gripper device 14 of FIGS. 2*a* to 2*d*, or the tongs-type gripper device 114 of FIGS. 3*a* to 3*c*, can be moved out of the periphery 16 of the downstream sheet-conveying cylinder 8 is in the range of several millimeters, for example.

We claim:

1. A method for transferring, by a trailing edge thereof, a sheet conveyed on an upline sheet-conveying cylinder to a gripper device of a downline sheet-conveying cylinder in a reversing device of a sheet-fed rotary printing press, the gripper device having sheet-holding surfaces for accepting the sheet trailing edge, which comprises lifting the sheet by the trailing edge thereof from the upline sheet-conveying cylinder; moving the sheet-holding surfaces of the gripper device out of the periphery of the downline sheet-conveying cylinder; with the sheet-holding surfaces of the gripper device, accepting the sheet trailing edge outside the periphery of the downline sheet-conveying device; and moving the sheet-holding surfaces back into the periphery of the downline sheet-conveying cylinder, after the sheet trailing edge has been accepted by said sheet-holding surfaces.

2. The method according to claim 1, wherein the acceptance by the sheet-holding surfaces of the sheet trailing edge occurs a few radians away from an imaginary connecting line between the centers of rotation of the upline and the downline sheet-conveying cylinders.

3. The method according to claim 1, which includes accepting the sheet trailing edge with the sheet-holding surfaces on or in the vicinity of a line running between the peripheries of the cylinders and disposed perpendicularly to an imaginary line connecting the centers of rotation of the upline and downline sheet-conveying cylinders.

4. The method according to claim 1, which includes moving the sheet-holding surfaces of the gripper device of the downline sheet-conveying cylinder several millimeters out of the periphery of the downline sheet-conveying cylinder.

5. The method according to claim 1, which includes swiveling the gripper device so as to move the sheet-holding surfaces out of the periphery of the downline sheet-conveying cylinder and back into the periphery.

6. The method according to claim 1, which includes, during the transfer of the sheet trailing edge to the sheet-holding surfaces of the gripper device, maintaining the sheet-holding surfaces of the gripper device and a sheet lifter at rest with respect to the downline sheet-conveying cylinder.

7. The method according to claim 1, which includes swiveling the suction gripper out of the periphery of the downline sheet-conveying cylinder so as to lift the sheet trailing edge from the upline sheet-conveying cylinder.

8. The method according to claim 1, which includes tautening the sheet trailing edge through the intermediary of the sheet-holding surfaces before the sheet is transferred by the trailing edge thereof to the gripper device.

9. The method according to claim 1, which includes, after the gripper device of the downline sheet-conveying cylinder has gripped the sheet trailing edge, swiveling the gripper device of the downline sheet-conveying cylinder so that the sheet-holding surfaces are oriented at least approximately in the direction of a length of the sheet extending from the upline sheet-conveying cylinder to the gripper device of the downline sheet-conveying cylinder.

10. The method according to claim 1, which includes, through the intermediary of the gripper device of the downline sheet-conveying cylinder, transferring the trailing edge of the sheet to a further gripper device of the downline sheet-conveying cylinder.

11. A device for transferring a sheet guided on an upline sheet-conveying cylinder by a trailing edge of the sheet to a downline sheet-conveying cylinder of a reversing device in a sheet-fed rotary printing press, comprising a device for lifting the sheet trailing edge from the upline sheet-conveying cylinder, and a gripper device disposed on the downline sheet-conveying cylinder and formed with sheet-holding surfaces movable out of the periphery of the downline sheet-conveying cylinder for accepting the sheet trailing edge from said lifting device outside the periphery of the downline sheet-conveying cylinder and for moving the sheet trailing edge back into the periphery of the downline sheet-conveying cylinder, after the sheet trailing edge has been accepted by said sheet-holding surfaces.

12. The transferring device according to claim 11, wherein said sheet-holding surfaces are movable for accepting the sheet trailing edge a few radians away from an imaginary line mutually connecting respective centers of rotation of the upline and the downline sheet-conveying cylinders.

13. The transferring device according to claim 11, wherein said sheet-holding surfaces of the gripper device are movable several millimeters outside of the periphery of the downline sheet-conveying cylinder.

14. The transferring device according to claim 11, wherein said sheet-holding surfaces of the gripper device are movable for accepting the sheet trailing edge on or in the vicinity of a line running between the peripheries of the upline and the downline sheet-conveying cylinders and disposed perpendicularly to an imaginary line connecting centers of rotation of the upline and the downline sheet-conveying cylinders.

15. The transferring device according to claim 11, wherein the gripper device is swivelable so that said sheet-holding surfaces are oriented at least approximately in the direction of a length of the sheet extending from the upline sheet-conveying cylinder to the gripper device.

16. The transferring device according to claim 11, wherein, during transfer of the sheet trailing edge to said sheet-holding surfaces of the gripper device, said sheet-holding surfaces of the gripper device and said sheet lifting device being at rest with respect to the downline sheet-conveying cylinder.

17. The transferring device according to claim 11, wherein said sheet lifting device is formed by a suction gripper swivelable out of the periphery of the downline sheet-conveying cylinder.

18. The transferring device according to claim 11, wherein said sheet lifting device is constructed so as to tauten the sheet before it is accepted at the sheet trailing edge thereof by the gripper device.

19. The transferring device according to claim 11, including a further gripper device for accepting the sheet by the trailing edge thereof, said further gripper device being disposed on the downline sheet-conveying cylinder.

20. The transferring device according to claim 19, wherein said further gripper device has a tongs-type gripper.

21. The transferring device according to claim 11, wherein the gripper device is formed by a tongs-type gripper device.

22. The transferring device according to claim 11, said upline sheet-conveying cylinder is an impression cylinder.

* * * * *